United States Patent [19]

Tsay

[11] Patent Number: 4,840,441

[45] Date of Patent: Jun. 20, 1989

[54] MULTI-FUNCTION SATCHEL

[76] Inventor: Hwa-Yang Tsay, 109, Cheng Shin Road, Kaohsiung, Taiwan

[21] Appl. No.: 155,497

[22] Filed: Feb. 12, 1988

[51] Int. Cl.[4] ..... A47R 27/00

[52] U.S. Cl. ..... 312/231; 108/64; 312/111; 312/233; 312/223

[58] Field of Search ..... 312/231, 109, 111, 233, 312/195, 196, 223; 108/1, 6, 64, 9

[56] References Cited

U.S. PATENT DOCUMENTS 2,151,259 3/1939 Young ..... 312/233 X
3,940,181 2/1976 Check ..... 108/6 X
4,227,758 10/1980 Clare ..... 312/111 X
4,409,906 10/1983 Alneng ..... 108/64
4,645,878 2/1987 Hilger et al. ..... 108/64 X

*Primary Examiner*—Joseph Falk
*Attorney, Agent, or Firm*—Larson and Taylor

[57] ABSTRACT

A multi-function satchel which can be carried on the shoulder of the user when folded up, thus holding books, stationary and the like. It can also be opened up to a wide flat surface for writing, reading or drawing by placing the two cases of this satchel side-by-side with their lids pivotally opened to provide a larger area or a bookrest. In addition, a lamp and dry batteries may be provided in this satchel for illumination purposes.

14 Claims, 9 Drawing Sheets

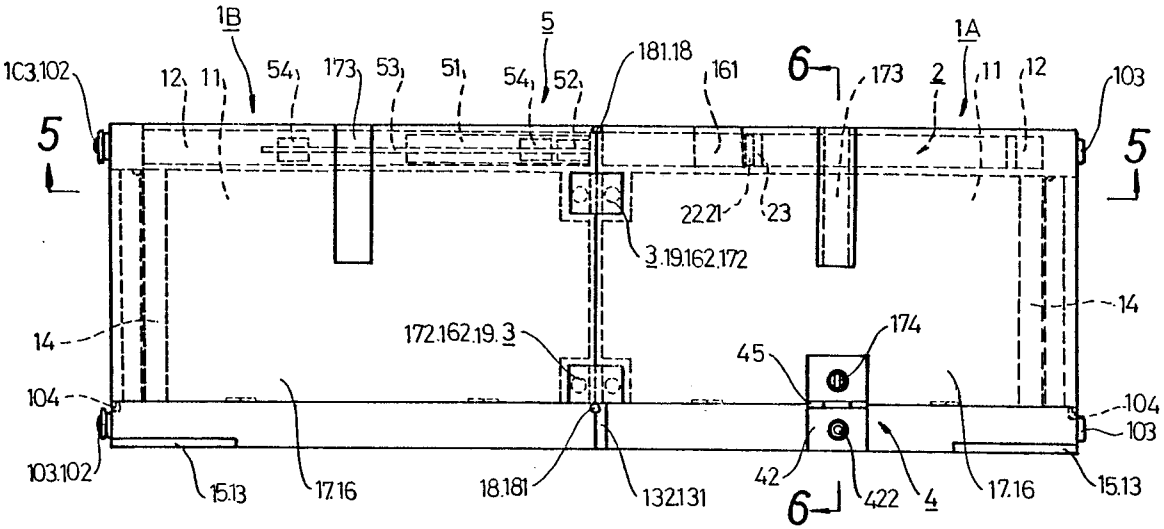
FIG. 4
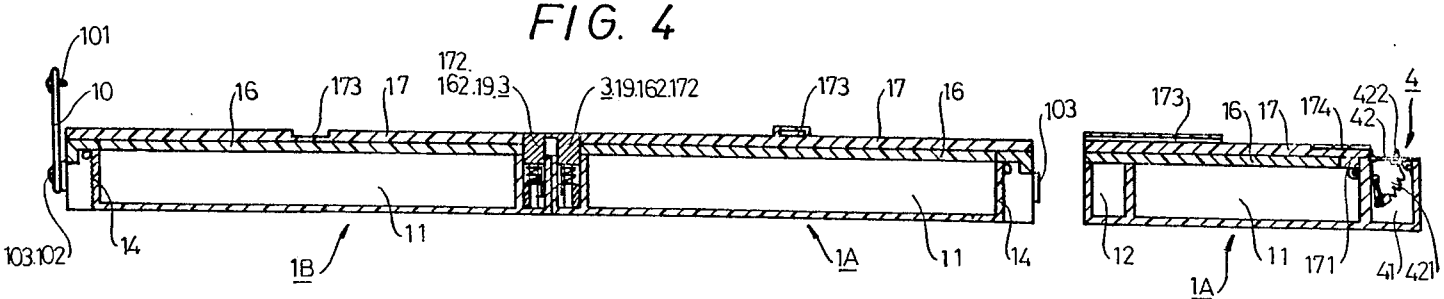
FIG. 5
FIG. 6

MULTI-FUNCTION SATCHEL

BACKGROUND OF THE INVENTION

A satchel is generally used only for carrying books and stationery, having no other functions. But sometimes pupils or students have to write or read outdoors and desks or other flat surfaces are not accessible. For example, if they draw sketches outdoors, they will need a drawing board to carry out with them. So it is not convenient.

This multi-function satchel comprises two cases which are combined together closed against each other as a satchel to carry with a strap or placed side by side with their lids opened making up a wide flat surface for writing, drawing or reading. In addition, there is a lamp in the satchel for illumination.

SUMMARY OF THE INVENTION

The object of this invention is to provide a satchel which not only can be used for carrying books but also can be used for writing, drawing or reading.

BRIEF DESCRIPTION OF THE DRAWINGS

This invention will now be described in detail with reference to the accompanying drawings wherein:

FIG. 4 is an plan view of this multi-function satchel in accordance with the present invention;

FIG. 5 is a cross-sectional view taken along line 5—5 of FIG. 4;

FIG. 6 is a cross-sectional view taken along line 6—6 of FIG. 4;

DETAILED DESCRIPTION OF THE INVENTION

Figure 1:
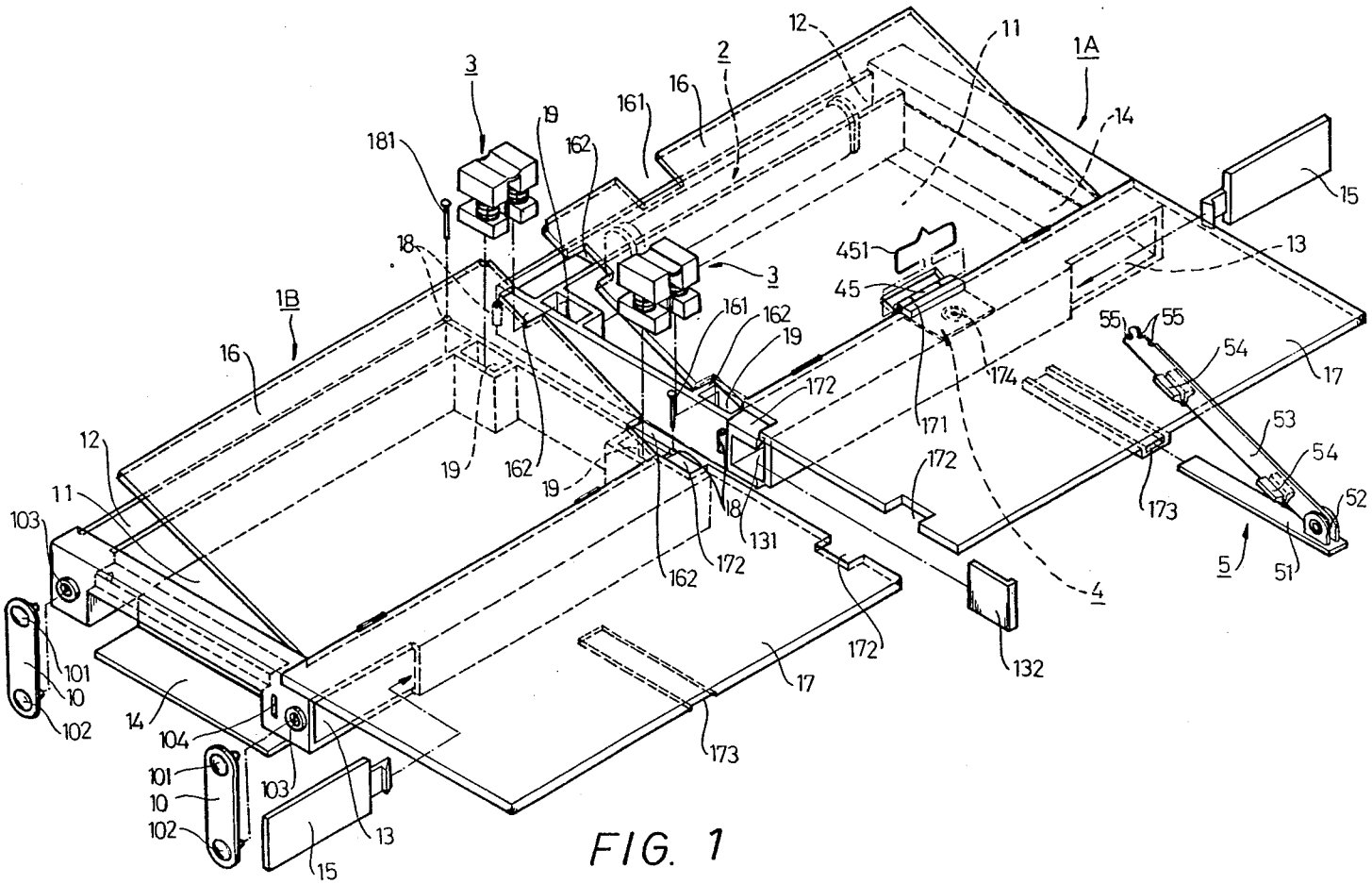
FIG. 1 is an exploded perspective view of this multi-function satchel in accordance with the present invention.

Firstly, this multi-function satchel as shown in FIG. 1 comprises case 1, a lamp 2, a connector 3, a supporting means 4 and a book pincher 5 as its main parts.

The case 1 comprise two cases 1A, 1B which are each provided with spaces 11, 12, 13. Each space 11 is used for holding books, provided with a movable lid 14 through which books can be put into or taken out. The space 12 in the case 1B is used for storing the book pincher 5, and each space 13 is used for storing stationery. A lid 15 is able to be hooked by a hook in each space 13 to close said space 13. The space 13 in the case 1A is also provided with a battery cell 131 partitioned therein for containing dry batteries and closed by a small lid 132. The battery cell 131 is wired with the lamp 2 for lighting said lamp 2.

Figure 2:
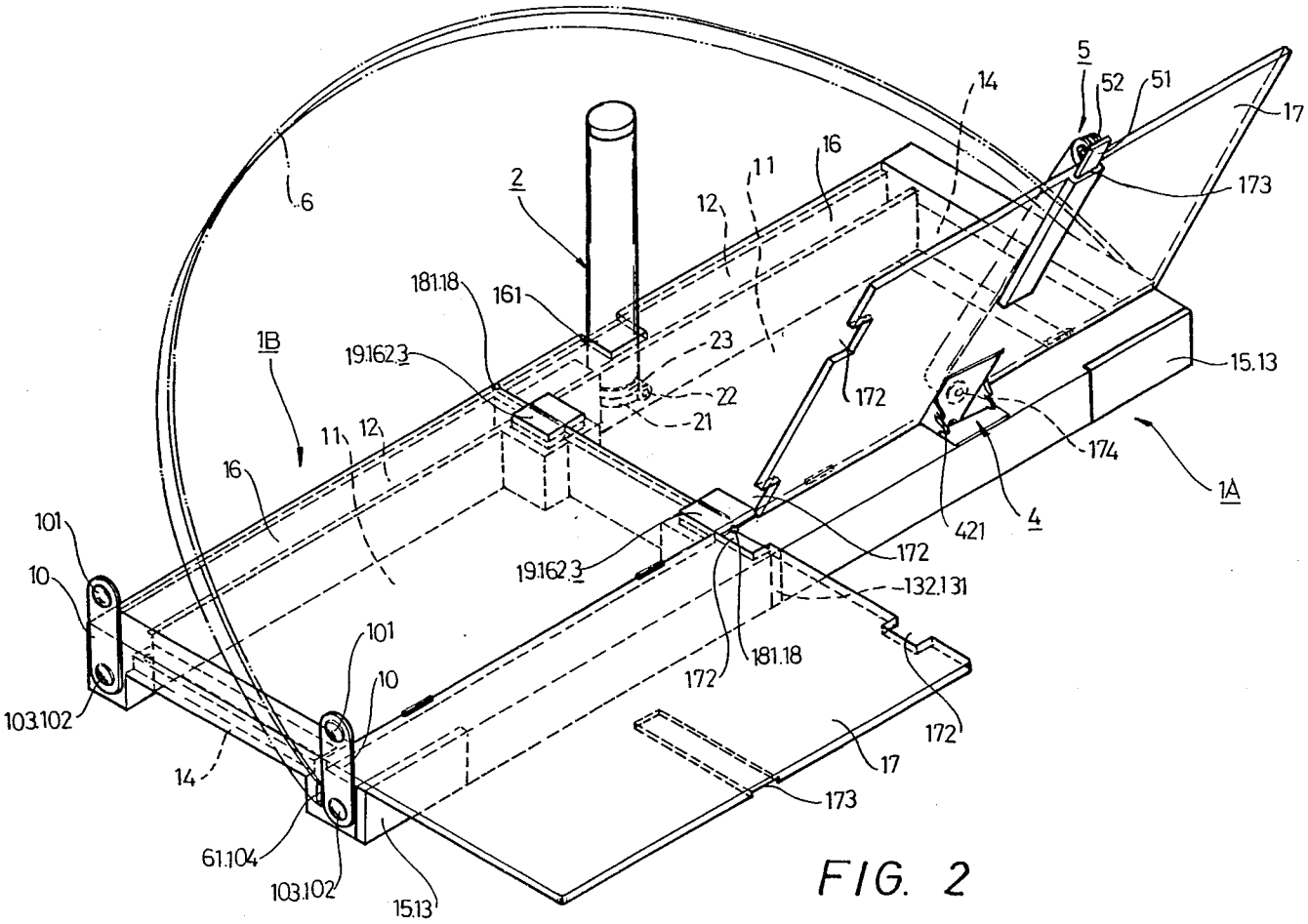
FIG. 2 is a perspective view of this multi-function satchel opened in accordance with the present invention.

Each of said cases 1A and 1B is also provided with a board 16, a lid 17 which are pivotally mounted on hinges movable to be opened or closed. When the boards 16 are closed on said cases 1A and 1B and said lids 17 are pivotally opened to the outside to lie flat, said boards 16 together with said lids 17 make up a wide flat surface for writing or reading. In addition lid 17 of the case 1A can also be made to tilt upwardly becoming a bookrest as shown in FIG. 2.

Said cases 1A, 1B can be combined together side by side, by means of a ring 18 separately fixed at an abutting side of cases 1A, 1B for a pin 181 to be inserted therein and a connecting hole 19 separately provided at the inside corner of the spaces 11 of said cases 1A, 1B for receiving a connector 3.

The board 16 of the case 1A is provided with a notch 161 for the lamp 2 to rest against when said lamp is made to stand up. Besides, the boards 16 of the cases 1A, 1B are provided with notches 162, and the lids 17 are provided with notches 172 for the connector 3. The lid 17 of the case 1A is provided with a groove 173 extending downward for receiving the book pincher 5, and the lid 17 of the case 1B is also provided with a groove 173 corresponding to the groove 173 of the case 1A for the groove 173 of the case 1A to fit therein when the cases 1A, 1B are closed against each other.

When the cases 1A, 1B are closed against each other, they are hooked together with two fastening bands 10 which are provided with two male fasteners 101, 102, said male fastener 101 fastening with a female fastener 103 on the case 1A and dsaid male fastener 102 with a female fastener 103 on the case 1B.

Figure 3:
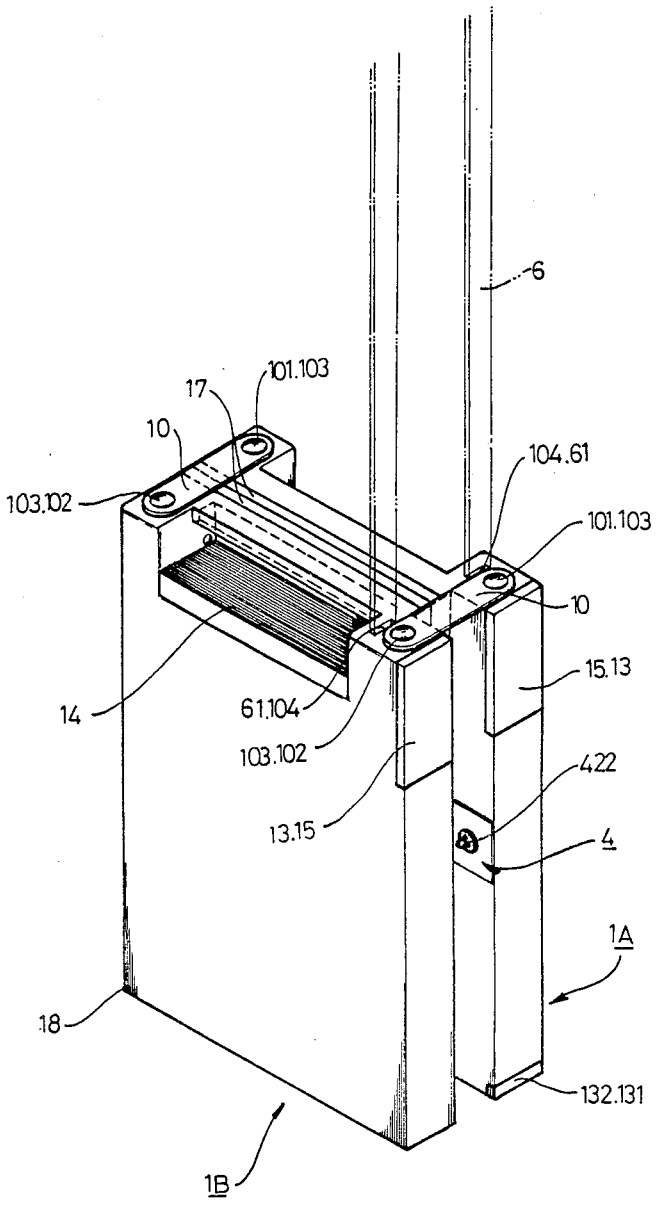
FIG. 3 is a perspective view of this multi-function satchel folded in accordance with the present invention.
Figure 7:
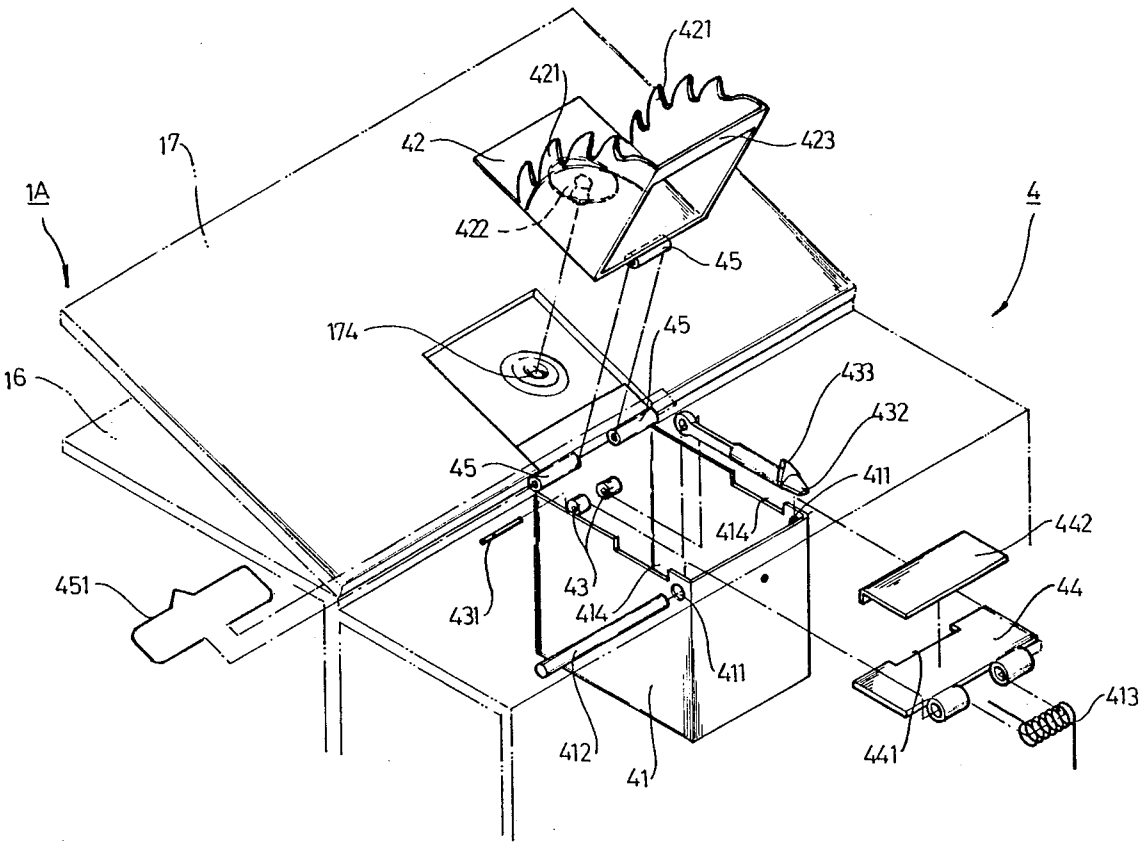
FIG. 7 is an exploded perspective view of the supporting means in this multi-function in accordance with the present invention.

In addition, said cases 1A, 1B are separately provided with a hooking hole 104 for the strap 6 to hook in for a user to hang this satchel on his/her shoulder after said cases 1A, 1B are put on each other as shown in FIG. 3 or to hang it on his/her neck for drawing, writing etc., when said cases 1A, 1B are placed as shown in FIGS. 2, 4, 5 and 13.

Next, in order to make up a comparatively wide flat surface for writing or reading, the connectors 3 are inserted in connecting holes 19 of the cases 1A, 1B, and pins 181 inserted in the rings 18 as shown in FIGS. 4, 5 and 6. In addition, the lid 17 of the case 1A can be made to stand up in order to form a bookrest to place an open book on it. It then needs the supporting means 4 to support it at that position.

The supporting means 4 comprises a base 41 fixed in the space 13 of the case 1A and a movable plate 42 provided with a male fastener 422 for fastening with a female fastener 174 set on the lid 17; the fastening power of said fasteners 174, 422 can keep said plate 42 and said lid 17 together, but when the load on either of them surpasses that fastening power, they become separated from each other.

Said base 41 and said movable plate 42 are pivotally mounted together on a pin 451 inserted in the rings 45 fixed on both 41 and 42, the movable plate 42 being able to turn with said pin 451 as a pivot. The base 41 is also provided with pin supporting rings 43 for a pin 431 to insert to mount a stopping bar 432 with a pointed end, said bar 432 being able to turn with said pin 431 as a pivot. Besides, said base 41 is provided with two pin holes 411 for a pin 412 to pivotally mount a stopping plate 44 and a replacing spring 413 is also adapted to be mounted on said pin 412 with one end pressing on the upper side of said plate 44 and with the other end pressing downward against the inside wall of said bases 41 keeping said plate 44 always having the elasticity to turn downward, said plate 44 being a little wider than said base 41 and being kept lying on both recessed side walls 414 of said base 412.

The movable plate 42 is pivotally mounted on the pin 451 combined with the rings 45 set on said plate 42 and on said base 41 and provided with the male fastener 422 on its back and with two sets of ratchet teeth 421 for the stopping plate 44 to hold at one of said teeth 421. Between two sets of said teeth 421 is fixed a horizontal bar 423 for the stopping bar 432 to engage.

The stopping plate 44 is normally pressed by the replacing spring 413 and lies on the recessed side walls 414, and is provided with a notch 441, which is hidden out of view by an L-shaped cover 442 welded on said plate 44, said notch looking like a groove if seen from the under side.

Figure 8:
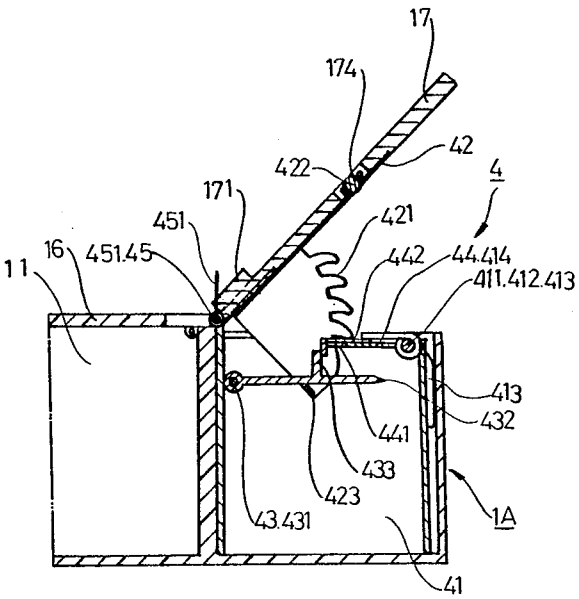
FIG. 8 is a vertical cross-sectional view of the first action of the supporting means in this multi-function satchel in accordance with the present invention.

As shown in FIG. 8, when the lid 17 is pivotally raised up and then lowered down to the right side, i.e. turned 180° for said lid 17 to be pressed on the movable plate 42 and fastening the female fastener 174 with the male fastener 422, in order to make the lid 17 as a bookrest, the lid 17 is then pivotally turned up again, bringing up said plate 42 with it. At this time, the ratchet teeth do not cause hampering action against said stopping plate 44, moving up with its rear part sliding past said plate 44, as the fastening power between both said fasteners 174, 422 is larger than the resisting power of said plate 42 being moved. Therefore, lid 17 can be held at the angle needed. If plate 42 is continuously turned up and stopping plate 44 is held at the lowest tooth of ratchet teeth 421, the horizontal bar 423 can touch the stopping bar 432. If plate 42 is then turned up further again, stopping bar 432 can also be raised.

Figure 9:
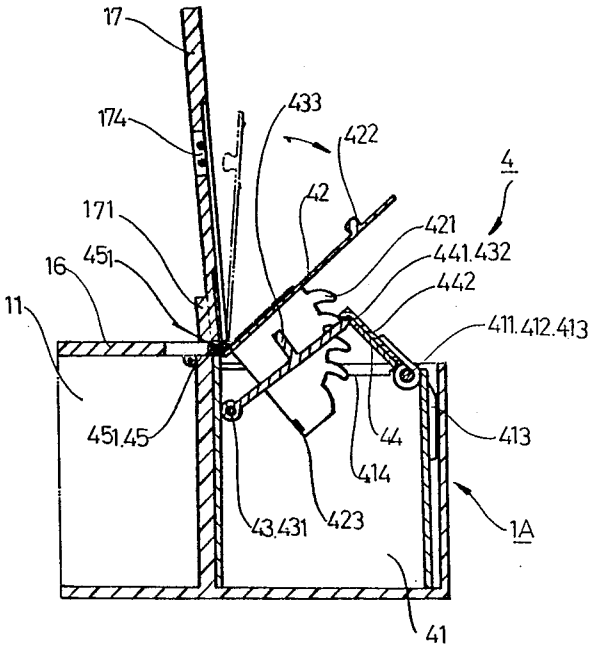
FIG. 9 is a vertical cross-sectional view of the second action of the supporting means in this multi-function satchel in accordance with the present invention.
Figure 10:
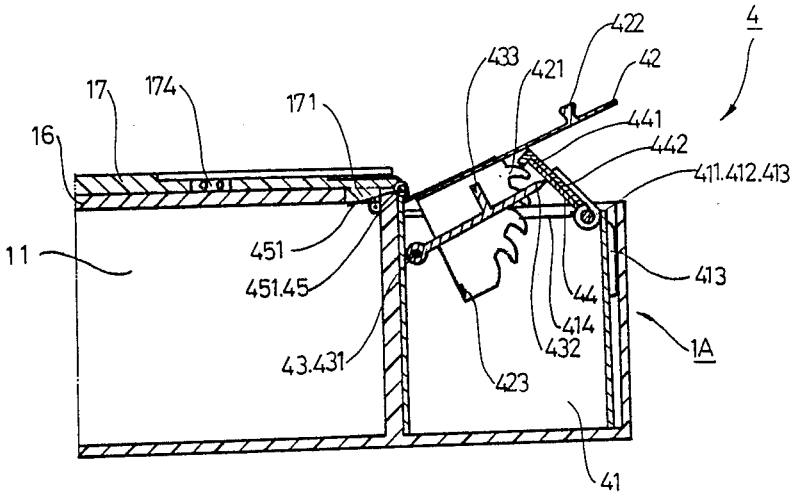
FIG. 10 is a vertical cross-sectional view of the third action of the supporting means in this multi-function satchel in accordance with the present invention.
Figure 11:
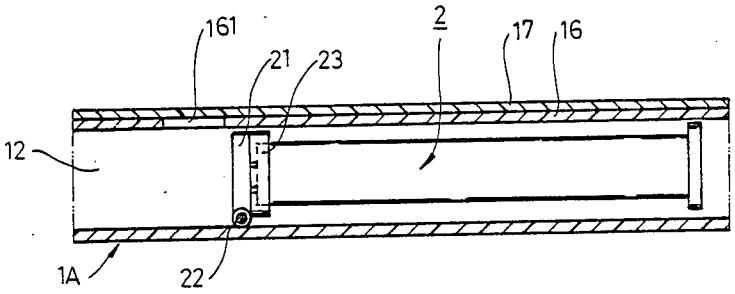
FIG. 11 is a horizontal cross-sectional view of the lamp in this satchel in accordance with the present invention.

Next, as shown in FIG. 9, when the stopping bar 432 continues to turn up, its pointed tip comes to be inserted in the notch 441 of said plate 44, which is already out of the path of the ratchet teeth 421. Plate 42 then reaches the highest turning angle. At this time, both fasteners 174, 422 can separate from each other, plate 42 turning down owing to its own weight. When plate 42 continues to move down and the ratchet teeth 421 go down to be touched by the stopping plate 44, plate 42 can touch the post 433 of the stopping bar 432, bar 432 moving off the notch 441 of said plate again as shown in FIG. 10, said plate 44 being returned to its original position forced by the resilient power of the spring 413 and lying on the recessed side walls 414 of the base 41.

Next, the lamp 2 is set on a base 21 which is provided with a tube 22 for insertion of a pin to insert to enable the lamp to pivotally turn with the pin as a pivot. A socket 23 is fixed on base 21 for the lamp 2 to connect with, wired with the battery cell 131 so that the lamp can be lit with the batteries stored in cell 131.

Figure 12:
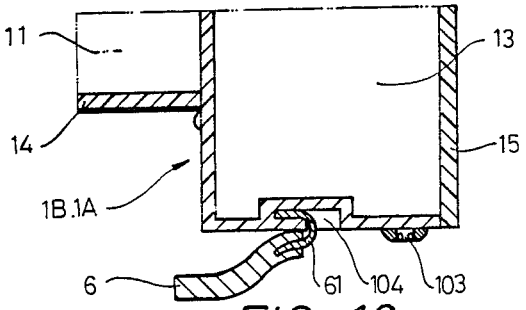
FIG. 12 is a cross-sectional view of the strap hooked on this satchel in accordance with the present invention.

The strap 6 is provided, as shown in FIG. 12, with a hook 61 at each end, which hooks in a hook hole 104 separately in the cases 1A and 1B for carrying this satchel on a user's shoulder.

Figure 13:
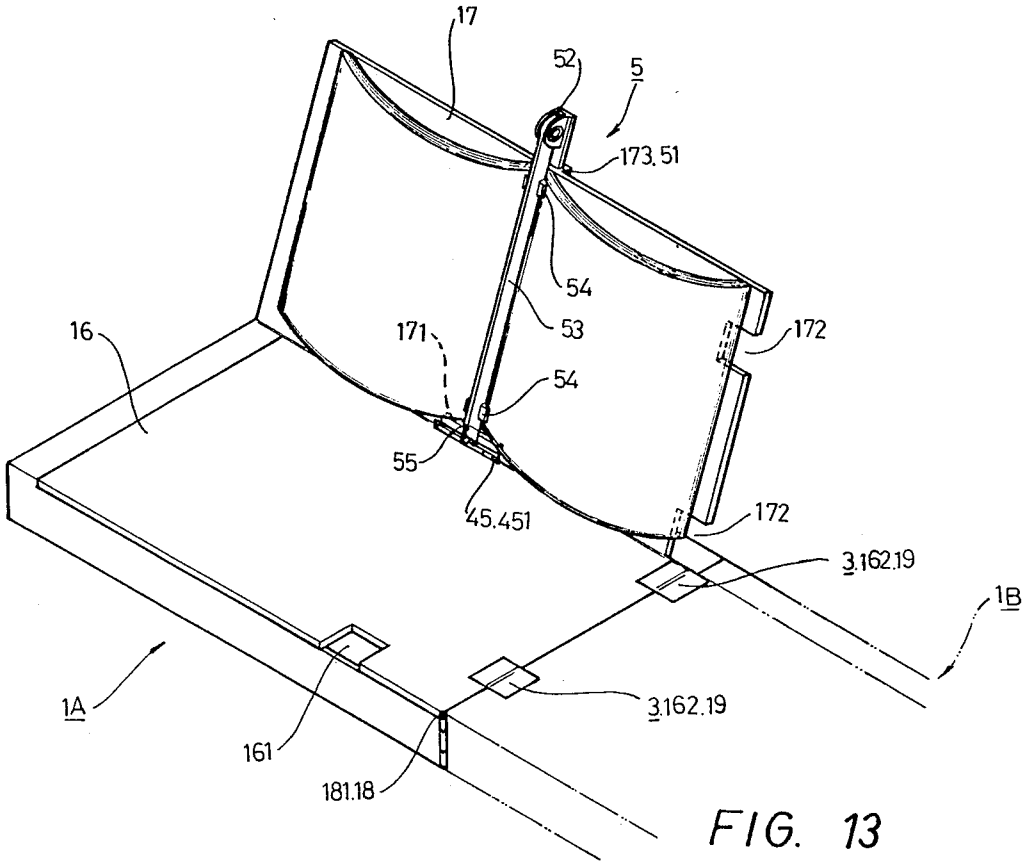
FIG. 13 is a view of the bookrest combined in this satchel in accordance with the present invention.
Figure 14:
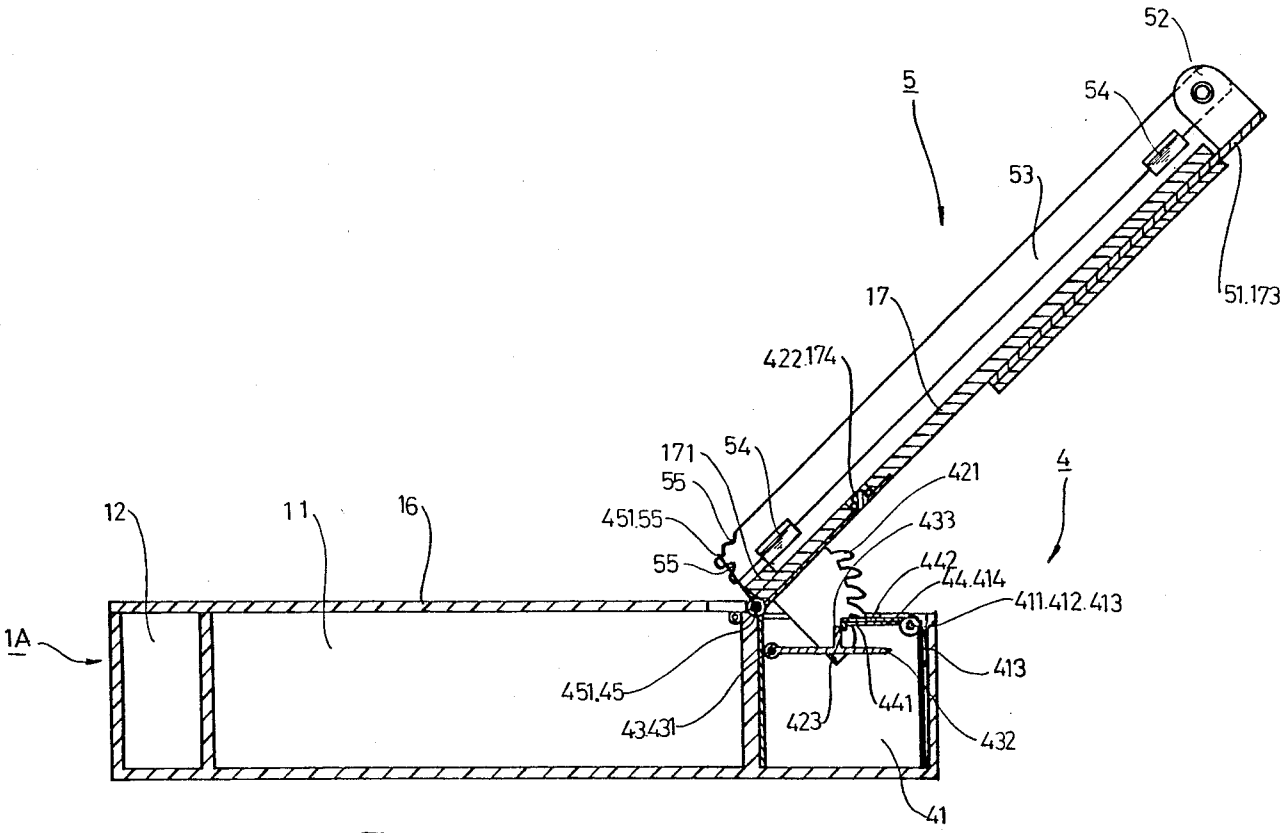
FIG. 14 is a side view of the book rest combined in this satchel in accordance with the present invention.

The book pincher 5 as shown in FIGS. 1 and 13 is held in the space 12 of the case 1A when it is not used, but when it is to be used, a plate 51 of the hook pincher 5 is to be inserted in the groove 173 of the case 1A. Said book pincher 5 is also provided with a sustaining base 52 for connecting a pressing bar 53, said bar 53 pivotally mounted ona pin set at said base 52. Pressing bar 53 is provided with two pressing blocks 54 to increase the pressing dimensions. The free end of the pressing bar 53 is provided with several hooking notches 55 to be hooked with a pin 451, which is shaped as a rectangle with a cut part and a protrusion at the rear, said protrusion being for hooking one of the notches 55. Pin 451 inserts in rings 45 on the base 41, the movable plate 42 and the lid 17 with the feet bent inside. Which one of said notches 55 is to be hooked with the pin 451 depends on the thickness of a book to be placed there.

In summary, this satchel can contain books in the spaces 11 of the cases 1A, 1B, the books being inserted through the lid 14 when opened; stationery can be stored in the space 13 through the lid 15 when opened; the lids 17 spread outside become a wide flat surface for writing and reading with the boards 16 when the two cases are placed side by side; the lid 17 of the case 1A can be also turned to stand up a little slantingly with help of a stopper 171, the book pincher 5 and the lamp 2.

What is claimed is:

1. A multi-function satchel comprising:

a pair of rectangular, generally flat cases which are separate from each other, each case comprising (a) a large rectangular side, an opposed large rectangular side, four peripheral walls separating said large side and opposed large side by a a short distance such that the sides and peripheral walls define a flat case volume, and an interior wall between the sides which separate the case volume into a large space and at least one smaller space, (b) a pivotally moveable board mounted to the case to cover the large side of the case, and (c) a moveable lid pivotally mounted to the case to lie over the board on the large side of the case, the movable lid being pivotable through 180° about its pivot axis to form a generally planar surface with the board when the board closes the large side of the case, first connecting means for connecting the cases together side by side with a peripheral wall of one case abutting a peripheral wall of the other case such that the respective two boards and the two lids, when turned through 180°, together form an enlarged, generally planar writing surface, a second connecting means for connecting the two cases closed upon each other with their respective boards and lids closed onto their respective large sides of the case and the two large sides facing each other, whereby the two large spaces store large objects such as books or the like, and wherein a peripheral wall of each said case includes an opening therein for access to its large space.

2. A multi-function satchel according to claim 1, said first connecting means comprising respective recesses formed into the large space of each cases, at a respective end thereof adjacent the other case, and a respective connector element engaging both adjacent recesses at each end.

3. A multi-function satchel according to claim 1, including an electric lamp in the smaller space of one of the cases, means for inserting dry batteries into that case, and means for electrically connecting the batteries to the lamp, said lamp being movable from a first position within its smaller space to a second position at least partially out of its smaller space.

4. A multi-function satchel according to claim 1, at least one case having a supporting means for holding its lid tilted upwardly to serve as a bookrest.

5. A multi-function satchel according to claim 4, including a book pincher connected to the tiltable lid for pressing a book against said raised lid.

6. A multi-function satchel according to claim 5, said case having a protruding notch for moutning the book pincher.

7. A multi-function satchel according to claim 1, each case having a ring hole at the end of the case adjacent the other case when they are side-by-side, and a pin insertable into the ring hole to secure the cases in position side-by-side.

8. A multi-function satchel according to claim 1, including supporting means comprising a movable plate, a base, said movable plate having a male fastener for fastening to a female fastener on the lid of the case, said plate having two sets of ratchet teeth, said base being provided with a stopping plate pivotally mounted on a pin held in a hole in the two sides of said base.

9. A multi-function satchel according to claim 8, said stopping plate positioned to normally lie on both recessed side walls of said base by means of a spring inserted on said pin and pressing said stopping plate downwardly, said stopping plate engagable with one of said ratchet teeth, said lid being capable of carrying said movable plate upwardly when said fasteners are fastened together and said stopping plate has engaged in one of said ratchet teeth, whereby said lid and said movable plate tilt upwardly for placing a book on said lid.

10. A multi-function satchel according to claim 1, at least one case having a supporting means for holding its lid tilted upwardly to serve as a bookrest, a stopping plate of said supporting means including a notch at one of its longer sides, said notch engagable with a pointed end of a stopping bar when said stopping bar is carried upwardly by said movable plate, said stopping bar having its other end pivotally mounted on a pin inserted in a pin supporter set on an inner wall of said base.

11. A multi-function satchel according to claim 1, at least one case having support means for holding its lid tilted upwardly to serve as a bookrest, a book pincher connected to the tiltable lid for pressing a book against said raised lid, a movable plate in said supporting means including a male fastener to fasten with a female fastener located on the lid of one of the cases so that this lid can carry the movable plate upwardly when the movable plate reaches the largest angle, moving downwardly with its weight and pressing a post of a stopping bar so that said stopping bar moves off of a notch of the stopping plate, said stopping plate being urged to its original position by a replacing spring.

12. A multi-function satchel according to claim 1, at least one cae having a supporting means for holding its lid tilted upwardly to serve as a bookrest, a book pincher connected to the tiltable lid for pressing a book against said raised lid, the lid of one of the cases including a downwardly extending groove for a plate of the book pincher, said plate of the book pincher connected with a pressing bar by means of a sustaining base, said pressing bar having several notches at its free end for engaging a pin connected to the lid for pressing the book down onto the bookrest.

13. A multi-function satchel according to claim 1, wherein each case includes a large space and two smaller spaces, one of the small spaces of one of the casings adapted to store a book pincher device.

14. A multi-function satchel according to claim 13, wherein the two smaller spaces of one case store an illuminating lamp and a lid supporting means, respectively, and a smaller space of the other case secures a book pincher.

* * * * *